US008570233B2

(12) United States Patent
Lindmark et al.

(10) Patent No.: US 8,570,233 B2
(45) Date of Patent: Oct. 29, 2013

(54) ANTENNA ASSEMBLIES

(75) Inventors: Björn Lindmark, Sollentuna (SE); Patrik Strömstedt, Täby (SE); Henrik Ramberg, Solna (SE); Kajsa From, Solna (SE)

(73) Assignee: Laird Technologies, Inc., Earth City, MO (US)

( * ) Notice: Subject to any disclaimer, the term of this patent is extended or adjusted under 35 U.S.C. 154(b) by 542 days.

(21) Appl. No.: 12/893,093

(22) Filed: Sep. 29, 2010

(65) Prior Publication Data

US 2012/0075155 A1 Mar. 29, 2012

(51) Int. Cl.
*H01Q 21/26* (2006.01)

(52) U.S. Cl.
USPC ..... 343/797; 343/703; 343/798; 343/817; 343/834; 343/835; 343/846; 343/894

(58) Field of Classification Search
USPC ..... 343/797, 703, 798, 817, 834, 835, 846, 343/894
See application file for complete search history.

(56) References Cited

U.S. PATENT DOCUMENTS

| | | | | |
|---|---|---|---|---|
| 2,846,678 | A | 8/1958 | Best | |
| 3,972,045 | A | 7/1976 | Perret | |
| 4,160,980 | A | 7/1979 | Murray | |
| 4,516,133 | A | 5/1985 | Matsumoto et al. | |
| 5,165,109 | A * | 11/1992 | Han et al. | 343/700 MS |
| 5,389,941 | A | 2/1995 | Yu | |
| 5,600,335 | A | 2/1997 | Abramo | |
| 5,835,067 | A * | 11/1998 | Goodman | 343/722 |
| 5,859,618 | A | 1/1999 | Miller, II et al. | |
| 6,025,798 | A | 2/2000 | Colombel et al. | |
| 6,034,649 | A | 3/2000 | Wilson et al. | |
| 6,067,053 | A * | 5/2000 | Runyon et al. | 343/797 |
| 6,198,457 | B1 | 3/2001 | Walker et al. | |
| 6,215,447 | B1 | 4/2001 | Johnson | |
| 6,239,750 | B1 | 5/2001 | Snygg | |
| 6,313,809 | B1 | 11/2001 | Gabriel et al. | |
| 6,333,720 | B1 | 12/2001 | Göttl et al. | |

(Continued)

FOREIGN PATENT DOCUMENTS

| | | |
|---|---|---|
| CN | 2658957 | 11/2004 |
| DE | 10035820 | 1/2002 |

(Continued)

OTHER PUBLICATIONS

Juin-Wei Huang, Chao-Shiun Wang, Chorng-Kuang Wang, and Shih-Huang Yeh, 'Vertical-Ground-Plane Transmission Lines for Miniaturized Silicon-Based MMICs', 2007, IEEE Radio Frequency Integrated Circuits Symposium, pp. 563-566.*

(Continued)

*Primary Examiner* — Jerome Jackson, Jr.
*Assistant Examiner* — Hai Tran
(74) *Attorney, Agent, or Firm* — Harness, Dickey & Pierce, P.L.C.

(57) ABSTRACT

Various antenna assemblies are disclosed. In one example, an antenna assembly includes a reflector including a first ground plane, a second ground plane below and spaced apart from the reflector, an antenna adjacent a surface of the reflector opposite the second ground plane, and a grounding post galvanically connecting the first ground plane and the second ground plane.

22 Claims, 14 Drawing Sheets

(56) References Cited

U.S. PATENT DOCUMENTS

| | | | | |
|---|---|---|---|---|
| 6,529,172 | B2 | 3/2003 | Zimmerman | |
| 6,597,324 | B2 | 7/2003 | Eriksson | |
| 6,646,606 | B2 | 11/2003 | Mikkola et al. | |
| 6,697,029 | B2 | 2/2004 | Teillet et al. | |
| 6,822,618 | B2 | 11/2004 | Bisiules et al. | |
| 6,917,346 | B2 | 7/2005 | Izzat et al. | |
| 6,933,906 | B2 | 8/2005 | Stolle et al. | |
| 7,053,843 | B2 | 5/2006 | Nysen | |
| 7,079,083 | B2 | 7/2006 | Gottl et al. | |
| 7,132,995 | B2 | 11/2006 | Gottl | |
| 7,173,572 | B2 | 2/2007 | Teillet et al. | |
| 7,196,674 | B2 * | 3/2007 | Timofeev et al. | 343/810 |
| 7,274,338 | B2 | 9/2007 | Ozkar et al. | |
| 7,283,101 | B2 | 10/2007 | Bisiules et al. | |
| 7,324,057 | B2 | 1/2008 | Argaman et al. | |
| 2002/0163476 | A1 | 11/2002 | Eriksson | |
| 2003/0090431 | A1 | 5/2003 | Gottl | |
| 2004/0252071 | A1 | 12/2004 | Bisiules et al. | |
| 2007/0080883 | A1 | 4/2007 | Boss et al. | |
| 2007/0152891 | A1 | 7/2007 | Fabrega-Sanchez et al. | |
| 2008/0024382 | A1 | 1/2008 | Uddin et al. | |
| 2008/0036674 | A1 | 2/2008 | Riedel et al. | |

FOREIGN PATENT DOCUMENTS

| | | |
|---|---|---|
| EP | 1054470 | 11/2000 |
| GB | 741911 | 12/1955 |
| WO | WO 94/14208 | 6/1994 |
| WO | WO 01/41257 | 6/2001 |
| WO | WO 2004/091050 | 10/2004 |
| WO | WO 2009/144211 | 12/2009 |
| WO | WO 2011/026034 | 3/2011 |

OTHER PUBLICATIONS

Biqun Wu et al; "â the magneto-electric multipole antenna—a new wideband antenna with pattern and polarization diversityâ", Antenna Technology (IWAT), 2010 International Workshop ON, IEEE, Piscataway, NU, USA, Mar. 1, 2010, pp. 1-4.

International Search Report and Written Opinion from PCT/IB2011/001889 which claims priority to the instant application; dated Jan. 25, 2012; 15 pages.

International Preliminary Report on Patentability, 5 pages, (and an English translated version, 6 pages) for PCT/EP2004/002206 (now PCT Publication WO 2004/091050; dated Jun. 9, 2004.

* cited by examiner

ANTENNA ASSEMBLIES

FIELD

The present disclosure relates to antennas and antenna assemblies.

BACKGROUND

This section provides background information related to the present disclosure which is not necessarily prior art.

Dual polarized antennas are used in various applications including, for example, base stations for wireless communications systems. When dual polarized antennas are used, crossed dipoles are commonly used as radiating elements. When crossed dipoles are used over a metal ground plane, it is important to achieve an adequate ground. An adequate ground may be achieved in numerous ways including, for example, by galvanic connection with the ground plane capacitive coupling to the ground plane, etc. The inventors hereof have recognized that various aspects of dipole antennas may benefit from improvement.

SUMMARY

This section provides a general summary of the disclosure, and is not a comprehensive disclosure of its full scope or all of its features.

According to various aspects, example embodiments are provided of antennas and antenna assemblies. In one example embodiment, an antenna assembly includes a reflector including a first ground plane, a second ground plane below and spaced apart from the reflector, a dipole antenna assembly adjacent a surface of the reflector opposite the second ground plane, and a grounding post galvanically connecting the first ground plane and the second ground plane.

In another example embodiment, a crossed dipole antenna assembly includes a first antenna member, a second antenna member, a third antenna member, and a fourth antenna member, a first ground plane, and a non-conductive spacer. Each of the first, second, third, and fourth antenna members is stamped from a single piece of metal. Each of the first, second, third, and fourth antenna members includes a dipole arm and a balun portion. The first and second antenna members are mechanically attached to the non-conductive spacer on opposing sides of the non-conductive spacer. The third and fourth antenna members are mechanically attached to the non-conductive spacer on opposing sides of the nonconductive spacer. The first, second, third, and fourth antenna members are positioned above and capacitively coupled to the first ground plane.

In yet another example, an antenna assembly includes a reflector including a first ground plane, a second ground plane below and spaced apart from the reflector, a plurality of antennas adjacent a surface of the reflector opposite the second ground plane, and a plurality of grounding posts galvanically connecting the first ground plane and the second ground plane. Each of the plurality of antennas is spaced apart from each other of the plurality of antennas along the surface of the reflector.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
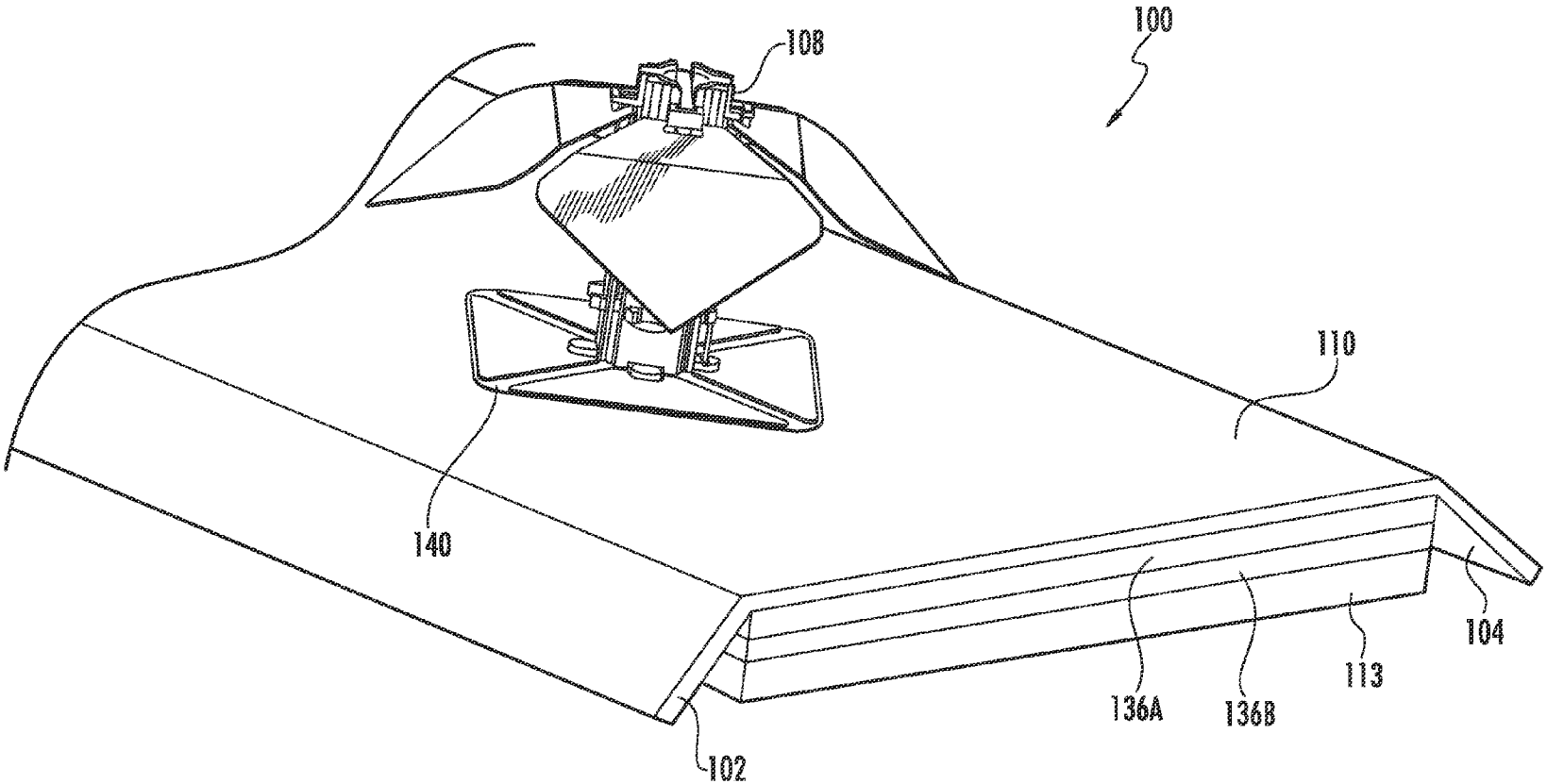
FIG. 1 is a top isometric view of an example antenna system including one or more aspects of the present disclosure.
Figure 2:
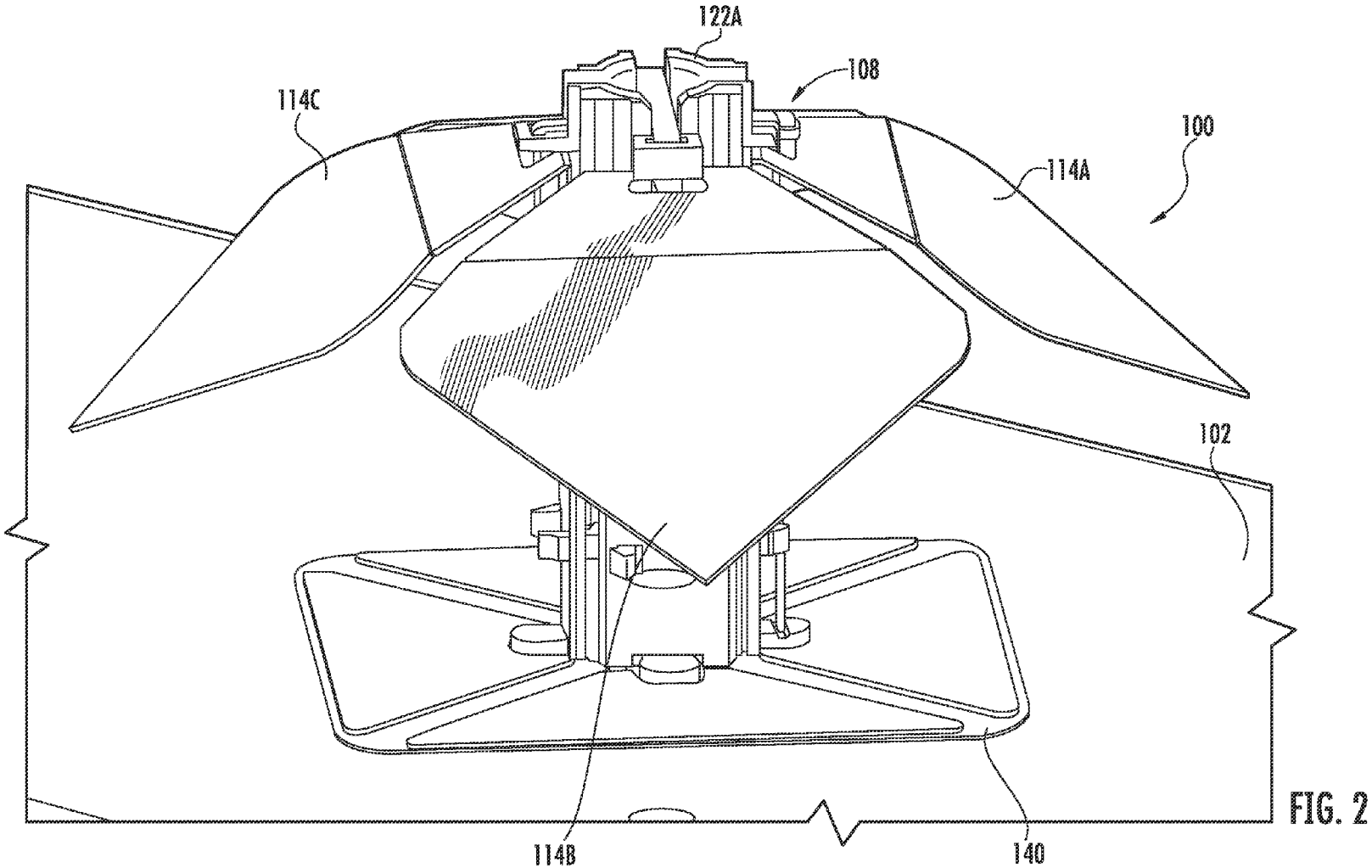
FIG. 2 is a top isometric view of a portion of the antenna system in FIG. 1.
Figure 3:
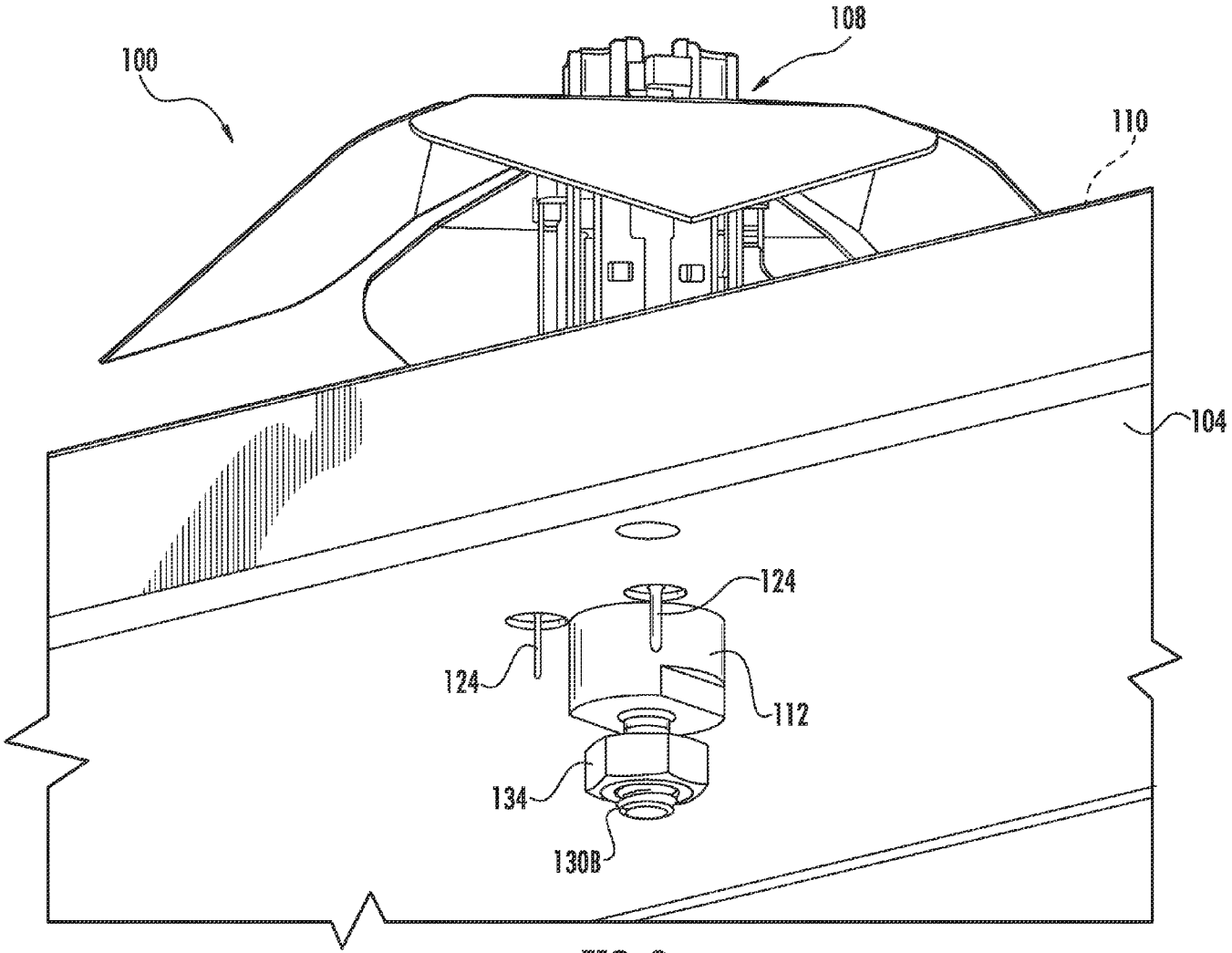
FIG. 3 is a bottom isometric view of the antenna system of FIG. 1 with the second ground plane, strip transmission line and insulating spacers removed.
Figure 5:
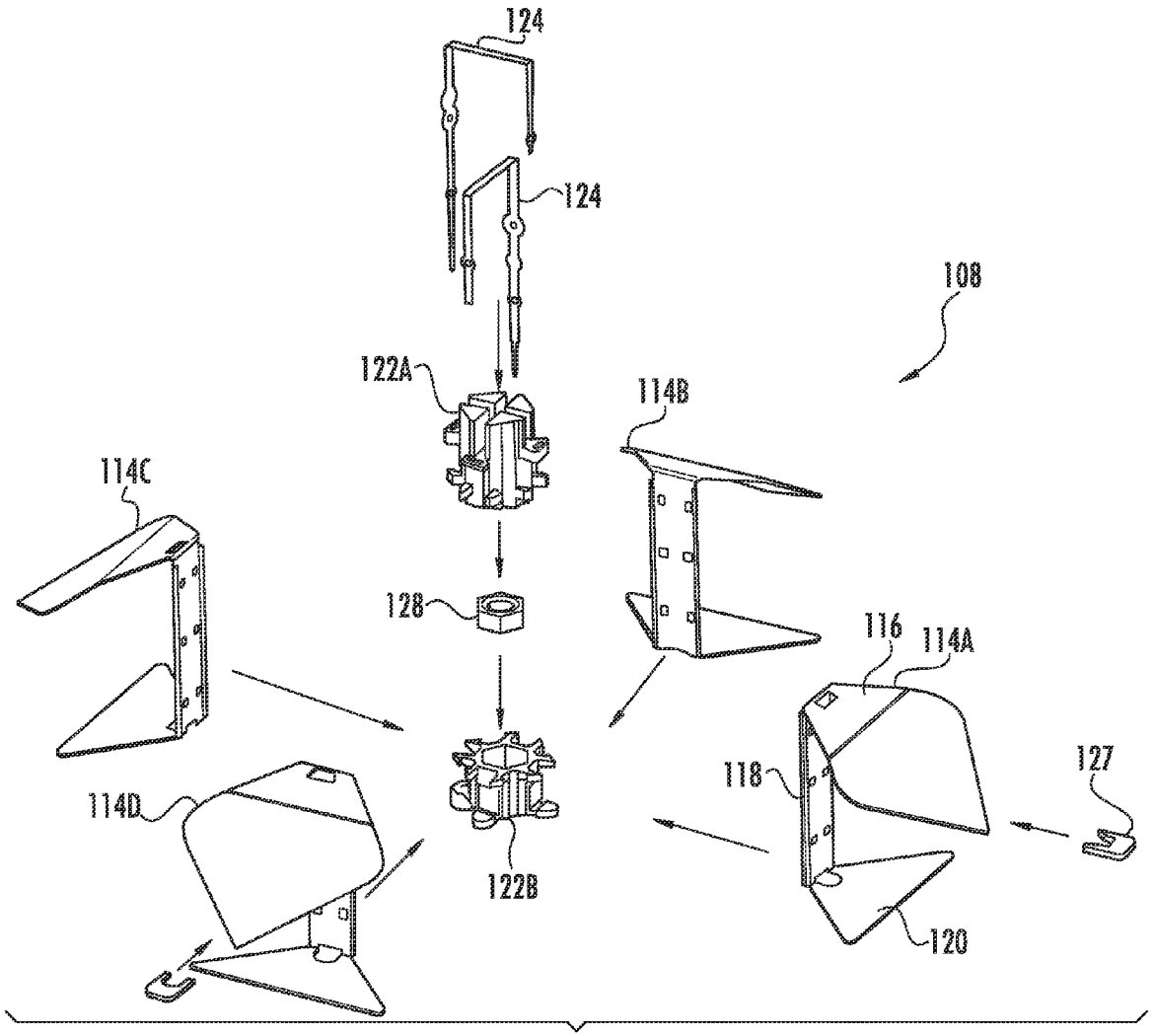
Figure 6:
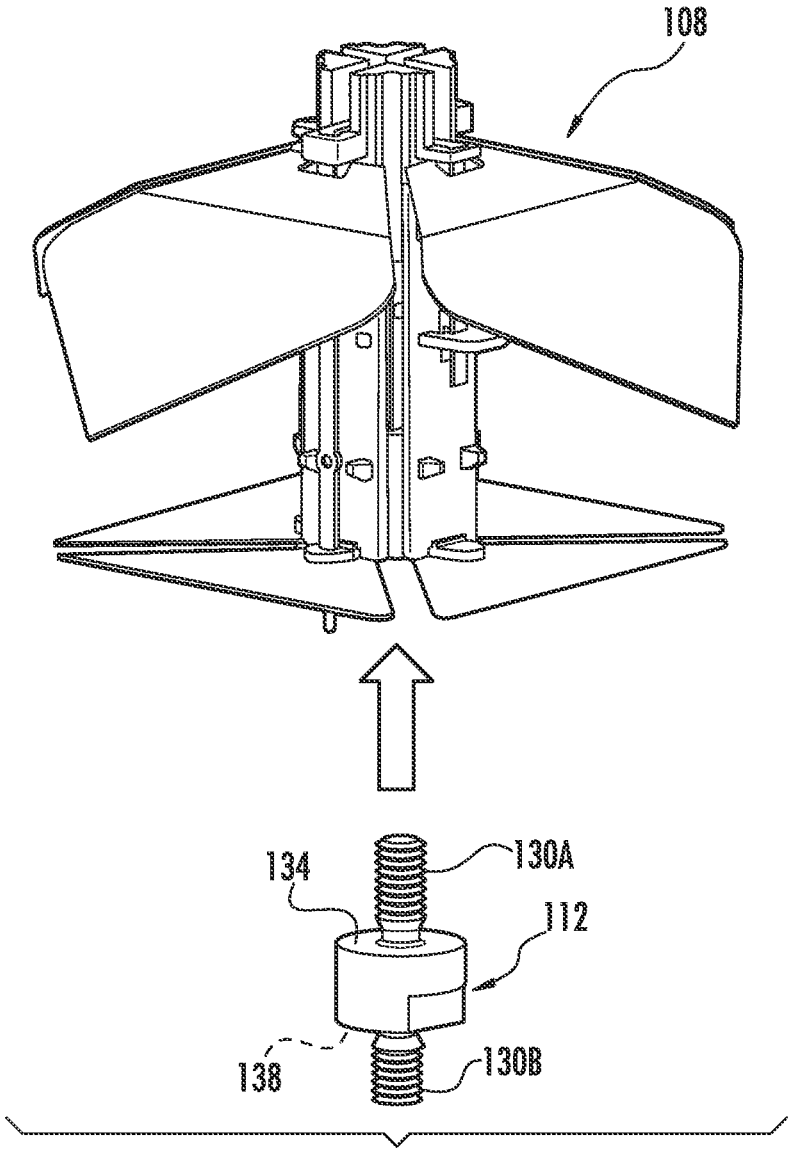
Figure 7:
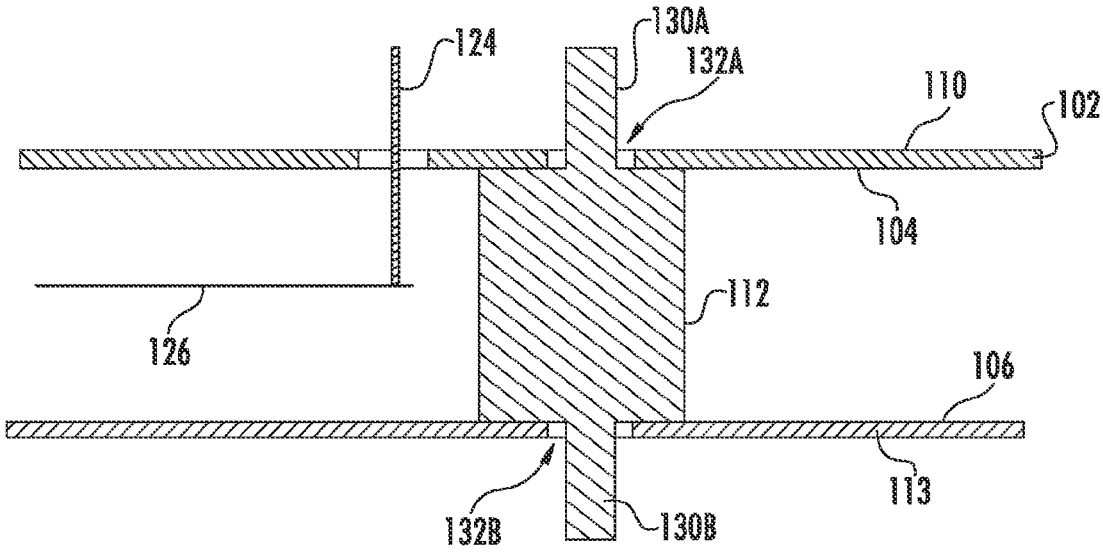
Figure 8:
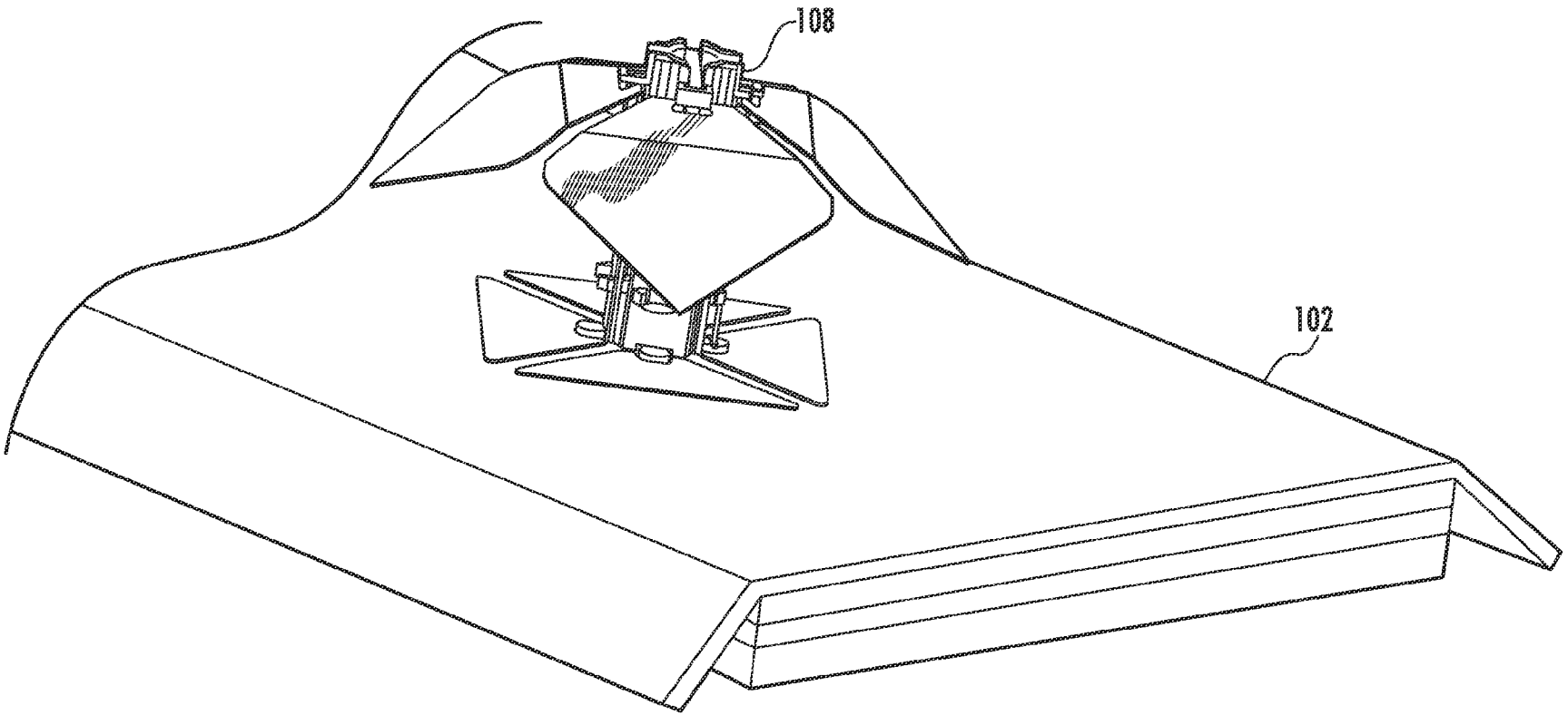
Figure 9:
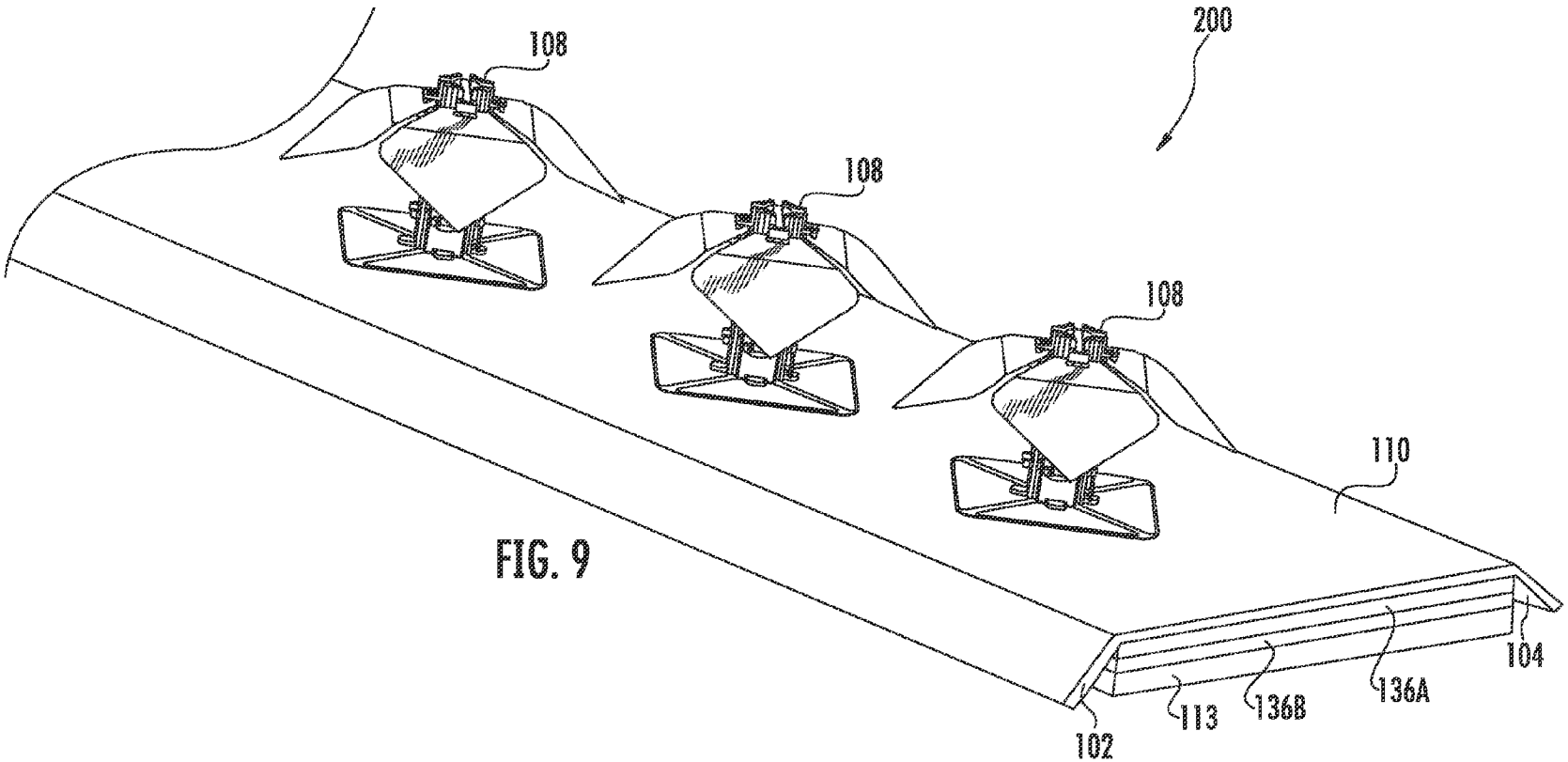
Figure 10:
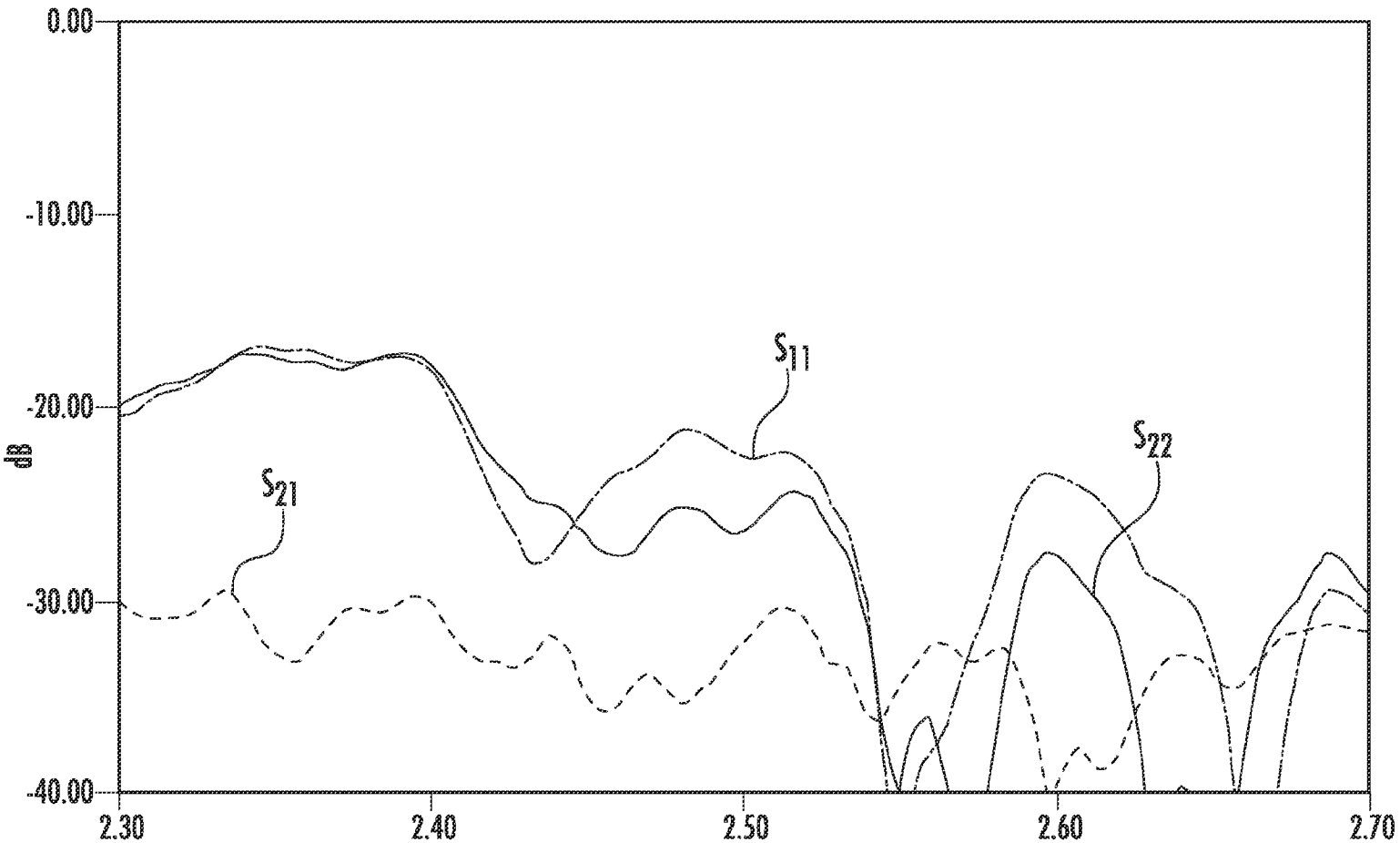
Figure 11:
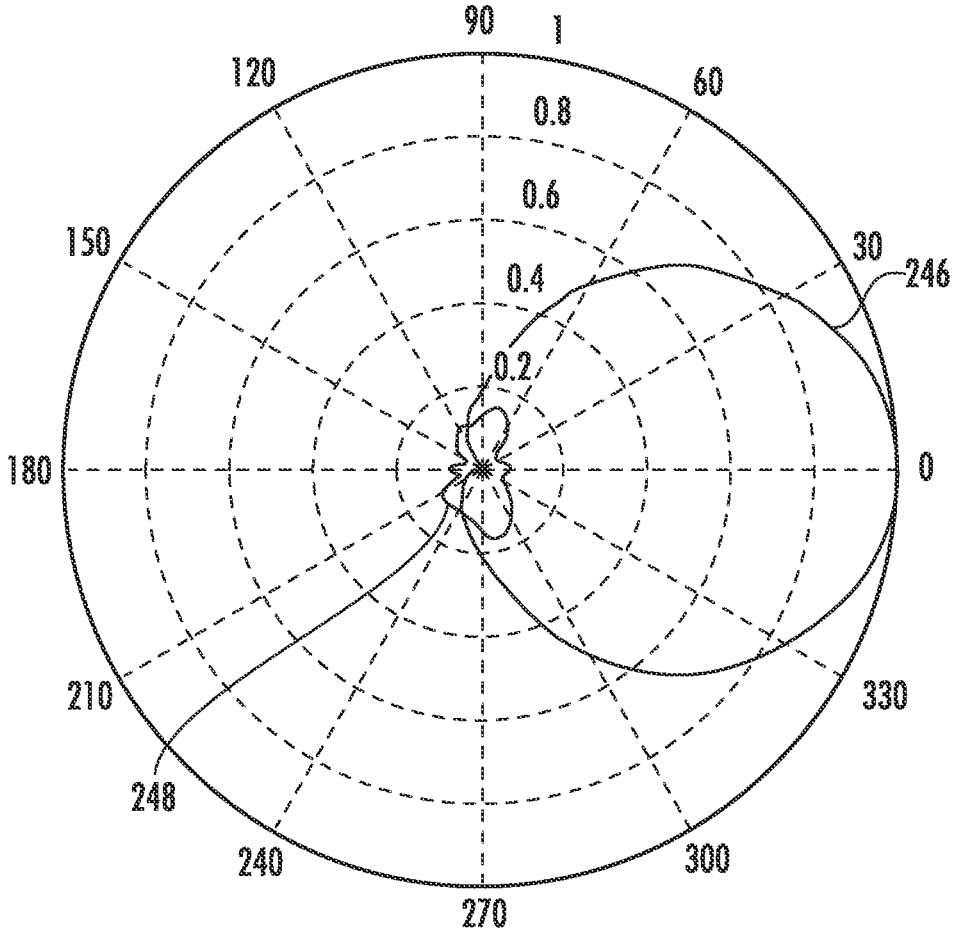
Figure 12:
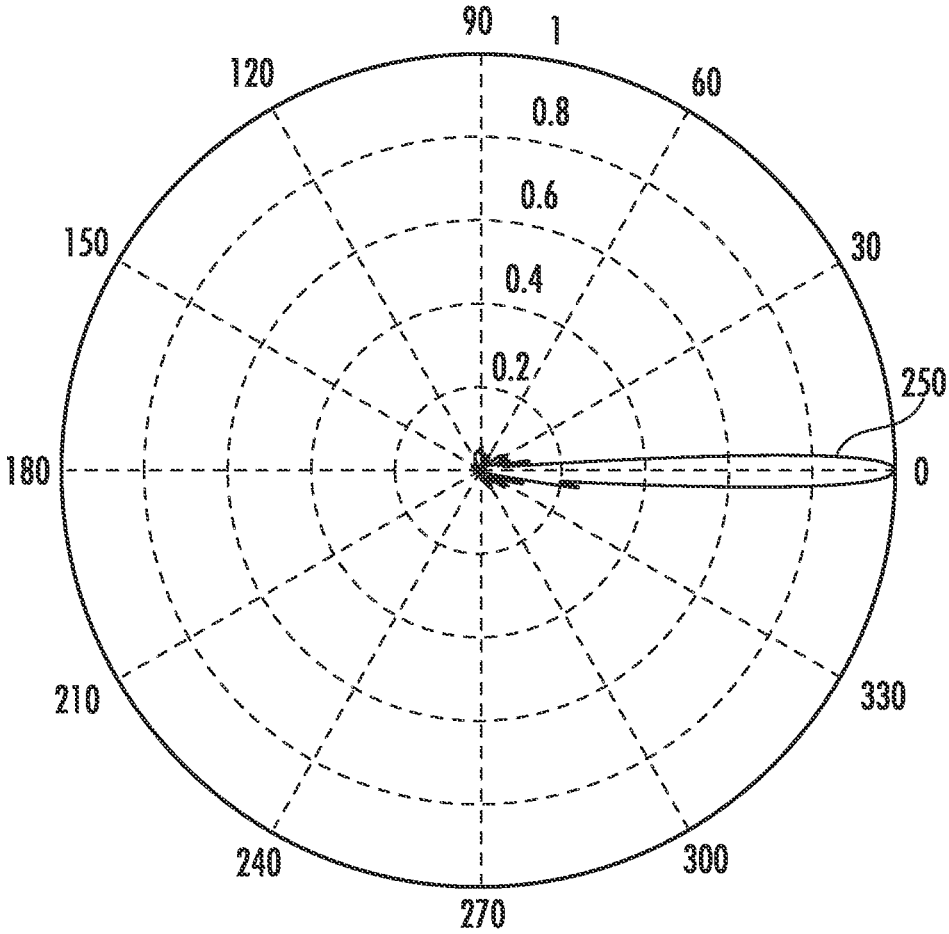
Figure 13:
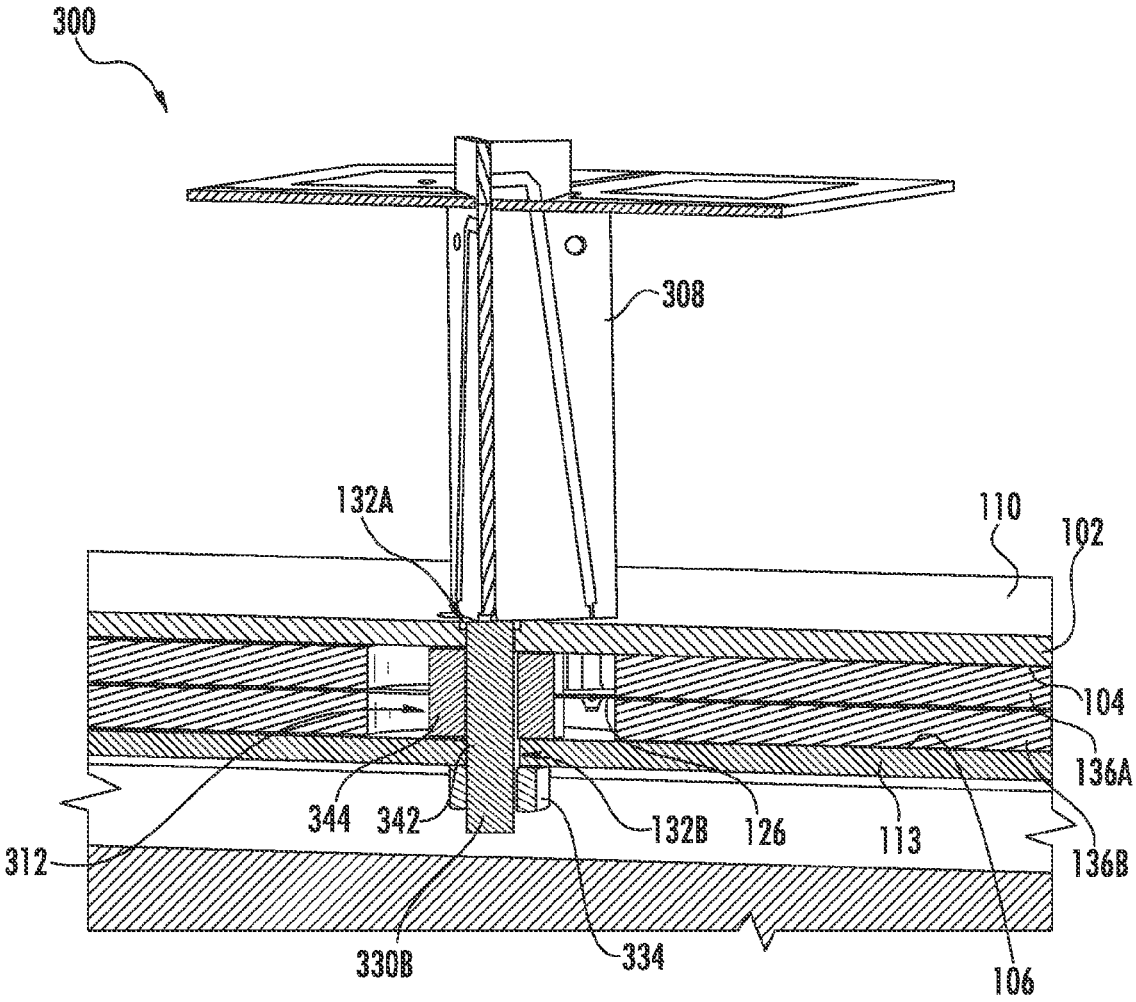
Figure 14:
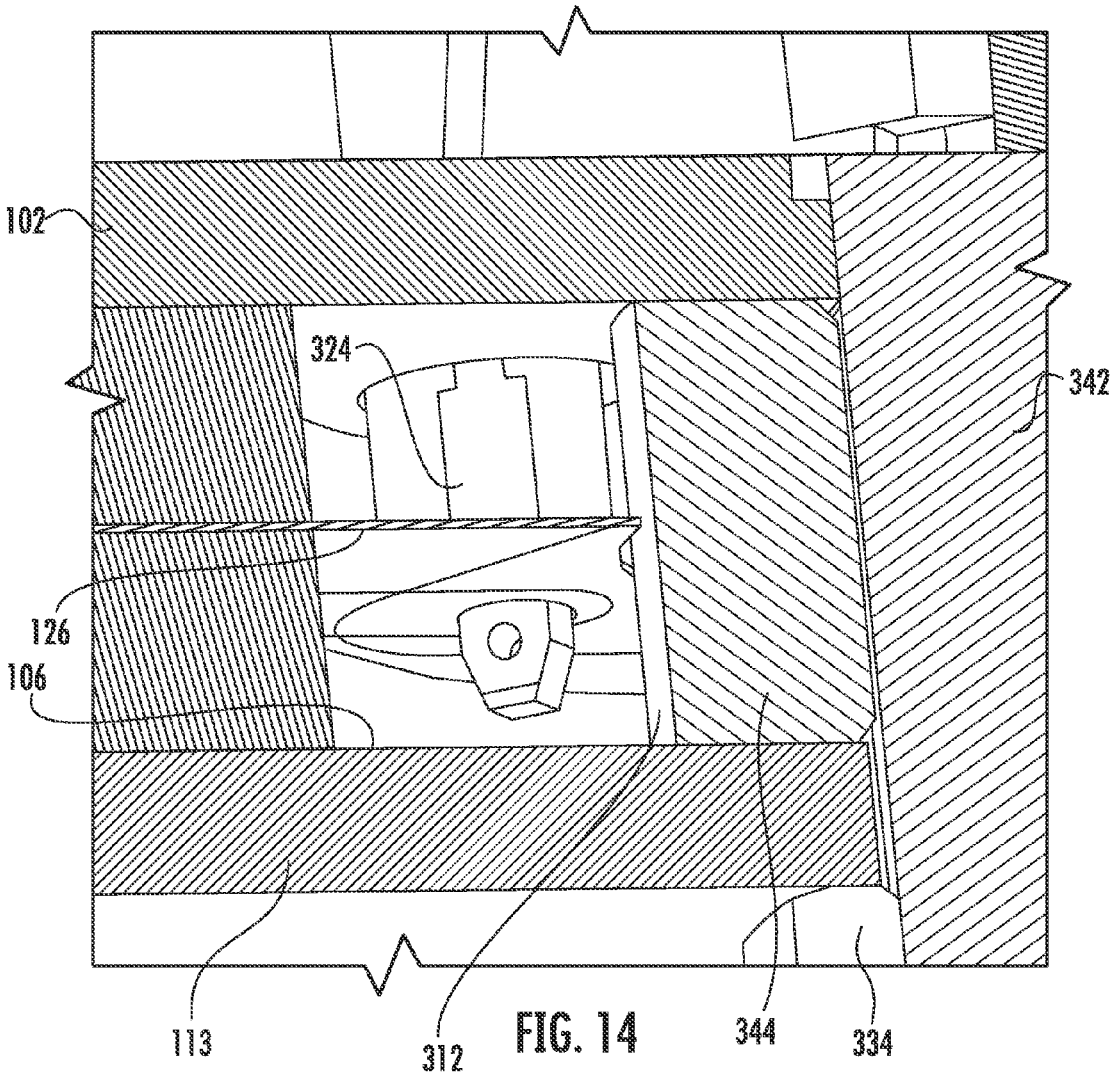

FIG. 5 an exploded view of the antenna of the antenna system in FIG. 1;

FIG. 6 is a top isometric view of the antenna of FIG. 5 and a grounding post;

FIG. 7 is a cross-sectional side view of the antenna system in FIG. 1 without the antenna attached;

FIG. 8 is a top isometric view of another example antenna system including one or more aspects of the present disclosure;

FIG. 9 is a top isometric view of yet another example antenna system including one or more aspects of the present disclosure;

FIG. 10 is a line graph illustrating measured reflection S11 and S22 and port-to-port coupling S21 in decibels for a sample antenna system including one or more aspects of the present disclosure over a frequency range of 2.3 gigahertz to 2.7 gigahertz;

FIG. 11 is radiation plot of the normalized co-polar and cross polar radiation patterns in the horizontal (azimuth) plane for the sample antenna system;

FIG. 12 is radiation plot of the normalized co-polar radiation pattern in the vertical (elevation) plane for the sample antenna system;

FIG. 13 is cross-sectional side view of another antenna system including one or more aspects of the present disclosure; and FIG. 14 is partial cross-sectional side view of a portion of the antenna system in FIG. 13.

Corresponding reference numerals indicate corresponding parts throughout the several views of the drawings.

DETAILED DESCRIPTION

Example embodiments will now be described more fully with reference to the accompanying drawings.

According to one aspect of the present disclosure, an antenna assembly includes a reflector including a first ground plane, a second ground plane below and spaced apart from the reflector, an antenna adjacent a surface of the reflector opposite the second ground plane, and a grounding post galvanically connecting the first ground plane and the second ground plane.

According to another aspect, a crossed dipole antenna assembly includes a first antenna member, a second antenna member, a third antenna member and a fourth antenna member, a first ground plane, and a non-conductive spacer. Each of the first, second, third, and fourth antenna members is stamped from a single piece of metal. Each of the first, second, third, and fourth antenna members includes a dipole arm and a balun portion. The first and second antenna members are mechanically attached to the non-conductive spacer on opposing sides of the non-conductive spacer. The third and fourth antenna members are mechanically attached to the non-conductive spacer on opposing sides of the nonconductive spacer. The first, second, third, and fourth antenna members are positioned above and capacitively coupled to the first ground plane.

An example embodiment of an antenna system or assembly, generally indicated by the reference number 100, according to various aspects of the present disclosure will be described with reference to FIGS. 1 to 7. The antenna assembly 100 includes a reflector 102. The reflector 102 includes a first ground plane 104. A shown in FIG. 7, a second ground plane 106 is located below and spaced apart from the reflector 102. The antenna assembly 100 includes an antenna 108. The antenna 108 is positioned adjacent a top surface 110 of the reflector 102 opposite the second ground plane 106. A grounding post 112 galvanically connects the first ground plane 104 and the second ground plane 106.

As illustrated, the first grounding plane 104 is a lower surface of the reflector 102, and the second ground plane 106 is an upper surface of a transmission line lid 113. In other embodiments, the first and second ground planes 104, 106 may be other surfaces, discrete ground planes, etc. The first ground plane 104 and the second ground plane 106 may be grounding planes for a strip transmission line, such as strip transmission line 126.

The antenna 108 in the illustrated embodiments of FIGS. 1-8 is a dipole antenna. More particularly, the antenna 108 is a crossed dipole. However, various aspects of this disclosure may be used with any suitable antenna topology including, for example, a single dipole, patch antennas, etc.

As shown in the exploded view of FIG. 5, the antenna 108 includes four antenna members 114A, 114B, 114C, and 114D (collectively and/or generically referred to herein as antenna members 114). The antenna members 114 each include a dipole arm 116 and a balun portion 118. The balun portions 118 may provide a balanced transmission line from the dipole arms 116 to the reflector 102. This may help ensure balanced currents on the dipole arms 116 and the balun portions 118, resulting in symmetrical radiation patterns with low cross-polarization. The antenna members 114 may each be stamped from a single piece of conductive material (e.g., metal, etc.). Alternatively, the antenna members 114 may be manufactured in any other suitable way including, for example, constructed of separate pieces of metal, etc. The conductive material for the antenna members 114 may be any suitable conductive material. In some embodiments, the conductive material is a metal such as, for example, stainless steel, aluminum, brass, etc. As can be seen, the dipole arms 116 join the balun portions 118 at an angle of approximately ninety degrees. The antenna members 114 may also include a base portion 120 extending from the balun portion 118 at an angle of about ninety degrees. When assembled and mounted above the reflector 102, the base portions 120 will be substantially parallel with the top surface 110 of the reflector 102.

The dipole arms 116 of the antenna members 114 are rhombic shaped and droop slightly toward the base portions 120 (and hence toward the reflector 102 when mounted on the reflector 102). This shape may improve impedance matching, isolation between the feed probes for the orthogonal polarizations, and change the shape of the radiation pattern. In particular, the dipole arms 116 result in a half-power beam width of 90 degrees in the horizontal plane.

The dipole arms 116 are about ¼ of the wavelength in free space of the resonant frequency, producing a dipole that is around ½ the wavelength in free space at the resonant frequency. However, the dimensions of the dipole arms 116 depend on their shape as well as the presence of dielectric material. For example, a narrow dipole arm 116 will typically need to be longer than a wider bow-tie dipole arm. Likewise, a dipole arm 116 printed on a dielectric substrate (as in other embodiments described herein) need to be slightly shorter than the corresponding dipole arm 116 in free space.

The antenna members 114 are mounted to an upper carrier 122A and a lower carrier 122B (collectively referred to herein as the carrier 122). Alternatively, the carrier 122 may be a single carrier (composed of a single piece rather than separate upper and lower carriers 122A, 122B). The carrier 122 may be formed of a non-conductive material. By forming the carrier from a non-conductive material, the antenna members may be galvanically separated from each other while being mechanically attached to each other (through the carrier 122) to form the antenna 108. The non-conductive material for the carrier 122 may be any suitable non-conductive material including, for example, a plastic such as a mixture of Polycarbonate and Acrylonitrile Butadiene Styrene (PC/ABS).

When the antenna members 114 are mounted to the carrier 122, they form two dipole antennas. Each pair of antenna members 114 on opposite sides of the carrier 122 forms a dipole. For example, antenna member 114A and antenna member 114C form a first dipole antenna, while antenna member 114B and antenna member 114D form a second dipole antenna. Thus, when assembled, the antenna members form two dipoles rotated ninety degrees from each other (when viewed from above), resulting in a crossed dipole antenna. Although this example embodiment includes two dipole antennas forming a crossed dipole, the antenna assembly 100 may include a single dipole antenna, multiple dipole antennas that are not crossed dipoles, etc.

The antenna 108 may also include feed probes 124. The feed probes 124 are constructed of a conductive material (e.g., metal, etc.) and couple signals between the antenna members 114 (and hence the first and second dipole antennas) and a strip transmission line 126 (shown in FIG. 7). The feed probes 124 excite a voltage across the gap between opposing antenna members 114. This voltage, in turn, induces radiating currents on the dipole arms 116, which provide the desired far-field radiation. The feed probes 124 may be galvanically connected to the opposing arm or may extend as an open or short-circuit stub transmission line along the balun portion 118 of the opposing antenna member 114. This may be used as degree of freedom in the impedance matching of the dipole antenna to the desired impedance and frequency. The feed probes 124 may be made of any suitable conductive material including, for example, copper, brass, nickel silver, etc. Because in some embodiments the feed probes 124 may be connected to the strip transmission line 126 via soldering, the feed probes 124 in such embodiments may be constructed of a material suitable for soldering.

The antenna 108 may also include one or more feed line spacers 127. The feed line spacers 127 are nonconductive spacers for spacing and maintaining position of the feed probes 124 relative to the antenna members 114. The feed line spacers 127 may be plastic or any other suitable non-conductive material. For example, in some embodiments, the feed line spacers are made of a mixture of Polycarbonate and Acrylonitrile Butadiene Styrene (PC/ABS). The feed line spacers 127 attach to the antenna members 114 via openings in the balun portions 118 of the antenna members 114.

The carrier 122 may also include a nut 128 embedded in (e.g., surrounded by, housed within, etc.) the carrier 122. The nut may be made of conductive material (e.g., metal, etc.), but may not contact the antenna members 114. The nut 128 is used for mechanical attachment of the antenna 108 to the reflector 102. Although illustrated as a separate nut 128 in this particular embodiment, the nut 128 may be integrally (e.g., monolithically, etc.) formed or created within the carrier 122. For example, the nut may be molded as part of the carrier 122, may be created by creating a threaded portion within the carrier 122 (e.g., by using a tap to cut threads within the carrier), etc.

Figure 4:
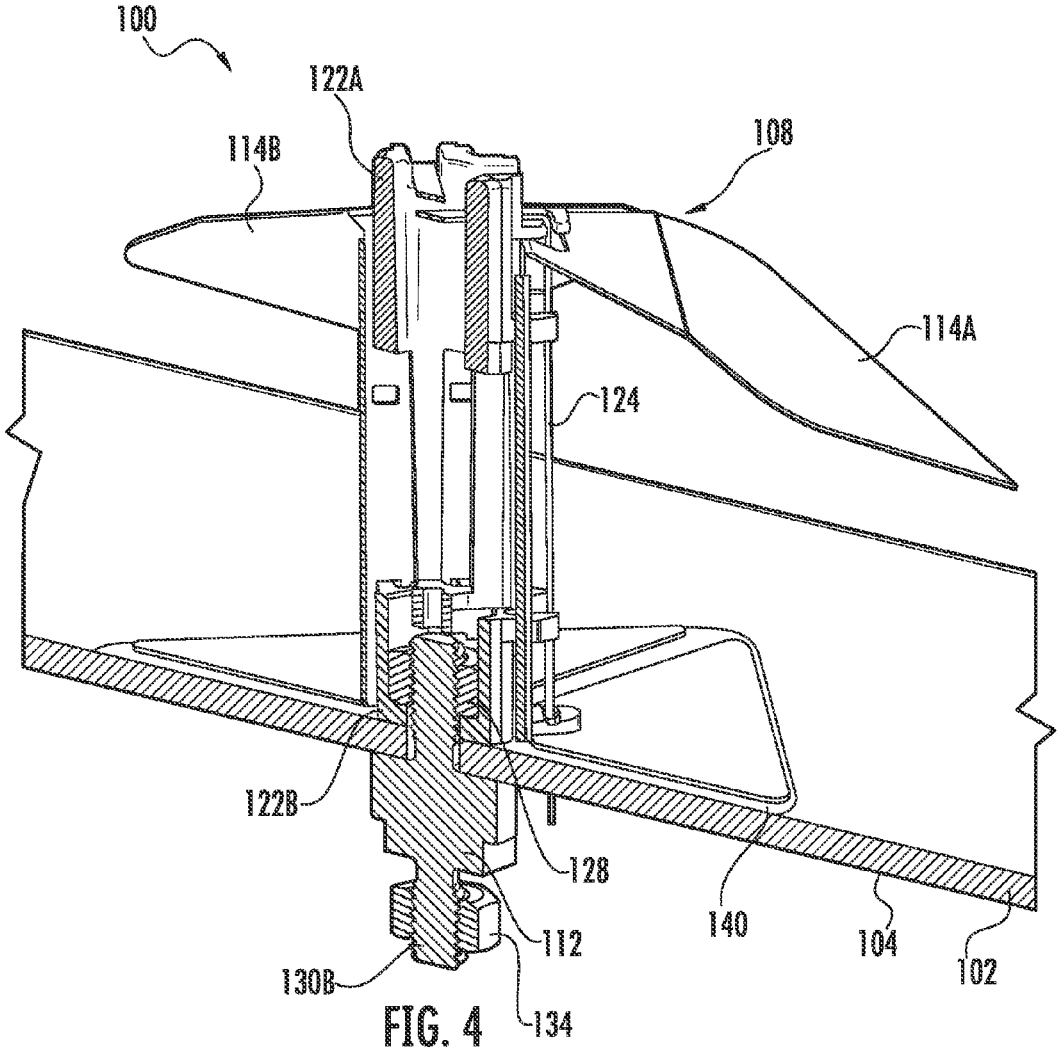
FIG. 4 is a cross-sectional side view of the antenna system shown in FIG. 3.

The antenna 108 may be mechanically connected to the reflector 102 using the grounding post 112. As will be discussed below, in other embodiments, the grounding post 112 is not used to mechanically connect the antenna 108 to the reflector. The grounding post 112 includes threaded portions 130A and 130B (collectively and generically, threaded portions 130). As best seen in FIGS. 4 and 7, when assembled to the reflector 102, the threaded portion 130A passes through a hole 132A in the reflector 102 and extends above the top surface 110 of the reflector 102. The threaded portion 130A matingly engages the nut 128 to mechanically couple the antenna 108 to the reflector 102. Similarly, the threaded portion 130B passes through an opening 132B in the second ground plane 106. A second nut 134 matingly engages the threaded portion 130B.

When the antenna assembly 100 is being assembled, the dipole antenna assembly (after itself being assembled) is positioned over the opening 132A in the reflector 102. The threaded portion 130A of the grounding post 112 may then be inserted through the opening 132A and into the antenna 108. The grounding post 112 may then be rotated to thread the threaded portion 130A into the nut 128. The grounding post 112 may be so rotated until a top surface 134 of the grounding post 112 is in sufficient contact with the first ground plane 104. At such time, insulating spacers 136A, 136B and strip transmission line 126 may be positioned adjacent the reflector 102. The insulating spacers 136 may be mechanically bonded to each other (e.g., glued, adhered, etc.) or may be unbonded. Similarly, the strip transmission line 126 may be bonded to one or both insulating spacers 136 or may be unbonded. The strip transmission line 126 is also galvanically connected to the feed probes 124 by any suitable connection (e.g. soldering, welding, adhesive glue, mating connectors, contact pins, etc.). When the portion of the antenna assembly 100 assembled as described above is positioned adjacent the lower ground plane 106, the threaded portion 130B passes through the opening 132B in the second ground plane 106. The second nut 134 may then be threaded onto the threaded portion 130B until a lower surface 138 makes sufficient contact with the second ground plane 106. Thus the first and second ground planes 104, 106 are galvanically connected by the grounding post 112.

In particular, the grounding post 112 establishes a connection between the first ground plane 104 and the second ground plane 106 at a location near the point where the strip transmission line 126 connects to the feed probes 124. This may reduce or eliminate any potential difference between the first and second ground planes 104, 106. Reducing or eliminating such a potential difference may in turn reduce or eliminate parallel plate modes propagating in the area of the strip transmission line 126 and thereby may reduce or eliminate spurious radiation.

The antenna 108 may be capacitively coupled to the first ground plane 106. Accordingly, the base portions 120 of the antenna members 114 are positioned close to, but without making galvanic connection to, the reflector 102. To maintain a space between the antenna members 114 and the reflector 102, an insulator 140 may be positioned between the base portions 120 and the reflector 102 (as shown, for example, in FIGS. 1, 2 and 4). The insulator 140 may be any suitable insulator including, for example, insulating tape, plastic, etc. Alternatively, the antenna 108 may be positioned in contact with the reflector 102 without any insulator or space between the base portions 120 and the reflector 102 (see, for example, FIG. 8 in which the antenna 108 is in direct contact with reflector 102).

The strip transmission line 126 couples signals to and from the antenna 108. The strip transmission line 126 may be any suitable strip transmission line. For example, the strip transmission line 126 may be conductive traces on a rigid circuit board, traces on a flexible circuit board, traces on flex film, etc.

The antenna assembly 100 may be used for any suitable purpose. For example, the antenna assembly may be used for a WiMAX base station antenna operating in the frequency range of 2300-2700 MHz. Alternatively, or additionally, the antenna assembly 100 may be used as single band or dual band radiating elements for wireless communication systems.

The antenna assembly or system 100 may include a single antenna 108 or may include more than one dipole assembly 108. The directivity of an antenna may be increased by the use of an array of more than one element (e.g., more than one antenna 108). FIG. 9 illustrates an antenna assembly or system 200 including multiple antennas 108. Base station antennas for wireless systems may use ten elements (e.g., ten antennas 108) with a vertical spacing of approximately 0.8 wavelengths. The vertical, or elevation, pattern is then determined primarily by the chosen excitation of the array elements, whereas the horizontal, or azimuth, pattern is determined by the combined properties of the antenna members 114 and the reflector 102

A sample antenna system similar to antenna system 200 was constructed and tested. The sample antenna consisted of ten antennas 108 with a vertical spacing of 104 millimeters (mm). The antenna members 114 were made from stainless steel and the feed probes 124 were made from in nickel silver. The transmission line 126 was implemented using copper etched on a 125 um thick polyester film. The film was placed between insulating spacers 136A and 136B made from Alveolit polyolefin foam manufactured by Sekisui Alveo AG, Luzern, Switzerland. The radiation patterns of the antenna were measured in a spherical near-field system manufactured and installed by SATIMO SA, Paris, France.

FIGS. 10 to 12 illustrate the results of the testing of the sample antenna system. FIG. 10 shows the measured reflection S11 and S22 and port-to-port coupling S21 of the sample antenna. As can be seen, the port-to-port coupling S21 remains low for the entire illustrated frequency band. This confirms that the grounding post 112 helps eliminate unwanted spurious fields between the ground planes 104 and 106. The normalized co-polar radiated field magnitude 246 and cross-polar radiated field magnitude 248 from the sample antenna in the horizontal (azimuth) plane are shown in FIG. 11. The normalized radiated co-polar radiated field magnitude 250 from the sample antenna in the vertical (elevation) plane is shown in FIG. 12. The cross-polar field magnitude in the vertical plane is too small to be visible in the same scale as the co-polar field in the vertical plane and is therefore not shown in FIG. 12. FIGS. 11 and 12 demonstrate that the sample antenna's radiated field does not have unwanted spurious radiation caused by the aforementioned parallel plate modes.

FIGS. 13 and 14 illustrate another example embodiment of an antenna assembly or system 300 according to various aspects of the present disclosure. The antenna assembly 300 includes the reflector 102. The reflector 102 includes the first ground plane 104. The second ground plane 106 is located below and spaced apart from the reflector 102. The antenna assembly 300 includes an antenna 308. The antenna 308 is positioned adjacent the top surface 110 of the reflector 102 opposite the second ground plane 106. A grounding post 312 galvanically connects the first ground plane 104 and the second ground plane 106.

The antenna 308 in the illustrated embodiments of FIGS. 13 and 14 is a dipole antenna. More particularly, the antenna 308 is a crossed dipole. However, various aspects of this disclosure may be used with any suitable antenna topology including, for example, a single dipole, patch antennas, etc.

The antenna 308 is made of printed circuit boards (PCBs). The PCBs may be any suitable PCBs (including, rigid, flexible, flex-film, etc.). The antenna 308 is galvanically connected to the reflector 102 using brackets (not shown) attached to the balun using soldering. In order to allow the use of soldering, the brackets are preferably made of brass or similar material. The antenna 308 is attached to the reflector 102 by a screw or similar arrangement.

The grounding post 312 includes a press screw 342 surrounded by a grounding sleeve 344. When assembled to the reflector 102, the press screw 342 fits in the opening 132A in the reflector 102. A threaded portion 330B of the press screw 142 passes through the opening 132B in the second ground plane 106. A nut 334 matingly engages the threaded portion 330B.

When the antenna assembly 300 is being assembled, the grounding post 312 is attached to the reflector by pushing the press screw 342 through the opening 132A until the grounding sleeve 344 makes sufficient contact with the first ground plane 104. The antenna 308 (after itself being assembled) is positioned over the opening 132A in the reflector 102 and attached to the reflector 102. At such time, insulating spacers 136A, 136B and strip transmission line 126 may be positioned adjacent the reflector 102. The strip transmission line 126 is also galvanically connected to feed probes 324 that depend down to the strip transmission line 126 from the antenna 308 by any suitable connection (e.g. soldering, welding, adhesive glue, mating connectors, contact pins, etc.). When the portion of the antenna assembly 300 assembled as described above is positioned adjacent the lower ground plane 106, the threaded portion 330B passes through the opening 132B in the second ground plane 106. The nut 334 may then be threaded onto the threaded portion 130B until the grounding sleeve 344 makes sufficient contact with the second ground plane 106. Thus, the first and second ground planes 104, 106 are galvanically connected by the grounding post 312.

In particular, the grounding post 312 establishes a connection between the first ground plane 104 and the second ground plane 106 at a location near the point where the strip transmission line 126 connects to the feed probes 324. This may reduce or eliminate any potential difference between the first and second ground planes 104, 106. Reducing or eliminating such a potential difference may, in turn, reduce or eliminate parallel plate modes propagating in the area of the strip transmission line 126 and thereby may reduce or eliminate spurious radiation.

In the example embodiments discussed above, the antennas (e.g., 108, 308, etc.) are described and illustrated positioned centered above a grounding post (e.g., 112, 312, etc.). In other embodiments, however, the antennas are not centered above a grounding post. For example, a patch antenna (e.g., a probe-fed patch, an aperture-fed patch, etc.) may be mechanically attached to the reflector 102 off-center from grounding post 312 (which connects the first and second ground plane 104, 106 at a location near the antennas feed probes or aperture).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

What is claimed is:

1. An antenna assembly comprising:
- a reflector including a first ground plane;
- a second ground plane below and spaced apart from the reflector;
- an antenna adjacent a surface of the reflector opposite the second ground plane;
- a strip transmission line positioned between the first ground plane and the second ground plane for coupling with the antenna; and
- a grounding post galvanically connecting the first ground plane and the second ground plane, the grounding post configured to maintain a spatial separation of the first ground plane and the second ground plane.

2. The antenna assembly of claim 1 wherein the grounding post mechanically connects the antenna to the reflector.

3. The antenna assembly of claim 1, further comprising at least one feed probe extending through the reflector and coupled to the antenna and to the strip transmission line, the at least one feed probe coupled to the strip transmission line at a location near grounding post thereby reducing or eliminating any potential difference between the first and second ground planes.

4. The antenna assembly of claim 2 wherein:
- the antenna includes a first dipole member and a second dipole member mounted to a carrier; and
- wherein the grounding post mechanically couples the antenna to the reflector via the carrier.

5. The antenna assembly of claim 4 wherein the carrier includes an upper carrier and a lower carrier formed of an electrically non-conductive material and a fastener for mechanical attachment to the grounding post.

6. The antenna assembly of claim 5 wherein the fastener is electrically conductive and is enclosed within the carrier.

7. The antenna assembly of claim 4 wherein:
- the antenna includes a third dipole member and a fourth dipole member;
- the first dipole member and the second dipole member form a first dipole radiator; and
- the third dipole member and the fourth dipole member form a second dipole radiator.

8. The antenna assembly of claim 7 wherein the first dipole radiator and the second dipole radiator are crossed dipoles.

9. The antenna assembly of claim 4 wherein:
- each of the first and second dipole members includes a dipole arm and a balun portion; and
- each of the first and second dipole members is formed from a single sheet of conductive material.

10. The antenna assembly of claim 9 wherein the first and second dipole members are each stamped from a single sheet of metal.

11. The antenna assembly of claim 2 wherein the antenna is capacitively coupled to the first ground plane.

12. A crossed dipole antenna assembly comprising:
- a first antenna member;
- a second antenna member;
- a third antenna member;
- a fourth antenna member;
- a first ground plane;
- a non-conductive carrier disposed above the first ground plane;
- wherein:
  - the first and second antenna members are mechanically attached to the non-conductive carrier on opposing sides of the non-conductive carrier;
  - the third and fourth antenna members are mechanically attached to the non-conductive carrier on opposing sides of the nonconductive carrier; and
  - the first, second, third and fourth antenna members are positioned above and capacitively coupled to the first ground plane.

13. The crossed dipole antenna assembly of claim 12 wherein:
- the first and second antenna members form a first dipole; and
- the third and fourth antenna members form a second dipole.

14. The crossed dipole antenna assembly of claim 13 further comprising:
- a second ground plane beneath and galvanically connected to the first ground plane; and
- a strip transmission line positioned between the first and second ground planes, and coupled to one of the first dipole and the second dipole at a location adjacent where the first and second ground planes are galvanically connected thereby reducing or eliminating any potential difference between the first and second ground planes.

15. The crossed dipole assembly of claim 14 further comprising:
- a first feed probe extending through the first ground plane to couple the strip transmission line to the first dipole; and
- a second feed probe extending through the first ground plane to couple the strip transmission line to the second dipole.

16. An antenna assembly comprising:
- a reflector including a first ground plane;
- a second ground plane below and spaced apart from the reflector;
- a plurality of antennas spaced apart along a surface of the reflector opposite the second ground plane;

a network of strip transmission lines positioned between the first ground plane and the second ground plane for coupling with the plurality of antennas; and a plurality of grounding posts galvanically connecting the first ground plane and the second ground plane, the plurality of grounding posts configured to maintain a spatial separation of the first ground plane and the second ground plane.

17. The antenna assembly of claim 16 wherein each of the plurality of grounding posts mechanically connects a different antenna of the plurality of antennas to the reflector.

18. The antenna assembly of claim 16, wherein each antenna is coupled to the network of strip transmission lines at a location near the grounding post that mechanically connects it to the reflector thereby reducing or eliminating any potential difference between the first and second ground planes.

19. The antenna assembly of claim 1, wherein the grounding post defines an upper surface and a lower surface spaced apart from the upper surface, and wherein the upper surface of the grounding post engages the first ground plane and the lower surface of the grounding post engages the second ground plane to thereby help maintain the spatial separation of the first ground plane and the second ground plane.

20. The antenna assembly of claim 19, wherein the grounding post includes an upper threaded portion protruding from the upper surface for use in coupling the antenna to the reflector, and a lower threaded portion protruding from the lower surface for use in coupling the grounding post to the second ground plane.

21. The antenna assembly of claim 1, further comprising at least one insulating spacer positioned between the first and second ground planes, the at least one insulating spacer containing the strip transmission line.

22. The crossed dipole antenna assembly of claim 12, wherein each of the first, second, third, and fourth antenna members is stamped from a single piece of metal, and wherein each of the first, second, third and fourth antenna members includes a dipole arm and a balun portion.

* * * * *